US007971754B2

(12) United States Patent
Kadyk

(10) Patent No.: US 7,971,754 B2
(45) Date of Patent: Jul. 5, 2011

(54) WATER BATH REFILL SYSTEM

(75) Inventor: Jeffery W. Kadyk, Sherman, IL (US)

(73) Assignee: Bunn-O-Matic Corporation, Springfield, IL (US)

( * ) Notice: Subject to any disclaimer, the term of this patent is extended or adjusted under 35 U.S.C. 154(b) by 311 days.

(21) Appl. No.: 11/751,546

(22) Filed: May 21, 2007

(65) Prior Publication Data

US 2007/0267440 A1 Nov. 22, 2007

Related U.S. Application Data

(60) Provisional application No. 60/747,795, filed on May 20, 2006.

(51) Int. Cl.
*B67D 5/56* (2006.01)

(52) U.S. Cl. ..... 222/129.1; 222/146.6; 222/144.5; 222/145.1

(58) Field of Classification Search ..... 222/146.6, 222/129.1, 144.5, 145.5, 109, 402.16, 527, 222/148

See application file for complete search history.

(56) References Cited

U.S. PATENT DOCUMENTS

| | | | | | |
|---|---|---|---|---|---|
| 2,499,061 | A * | 2/1950 | Gray | 222/324 |
| 2,691,986 | A * | 10/1954 | Kirby | 134/58 D |
| 4,522,789 | A * | 6/1985 | Kelly et al. | 422/133 |
| 4,592,490 | A * | 6/1986 | McMichael | 222/129.1 |
| 4,615,466 | A * | 10/1986 | Credle, Jr. | 222/129.1 |
| RE33,943 | E * | 6/1992 | Arzberger et al. | 62/127 |
| 5,279,446 | A * | 1/1994 | Cook et al. | 222/54 |
| 5,494,193 | A * | 2/1996 | Kirschner et al. | 222/129.1 |
| 5,797,519 | A * | 8/1998 | Schroeder et al. | 222/129.1 |
| 6,179,222 | B1 * | 1/2001 | Stecher | 239/112 |
| 6,374,867 | B1 * | 4/2002 | Maiuro | 141/2 |
| 6,438,989 | B1 * | 8/2002 | Wolski et al. | 62/390 |
| 6,488,216 | B1 * | 12/2002 | Lewis | 239/106 |
| 6,976,286 | B1 * | 12/2005 | Sanabria | 15/264 |
| 2006/0255060 | A1 * | 11/2006 | Miller | 222/63 |

* cited by examiner

*Primary Examiner* — Kevin P Shaver
*Assistant Examiner* — Donnell Long
(74) *Attorney, Agent, or Firm* — Barnes & Thornburg LLP

(57) ABSTRACT

A refill system and method of use for a beverage dispenser. The refill system includes a fill tube coupled to the water bath generally at an upper portion to dispense water into the water bath. The tube is configured for coupling to a dispense nozzle of the beverage dispenser. The beverage dispenser can be operated to dispense water only when the fill tube is coupled to the nozzle. The beverage dispenser can be controlled to prevent dispensing of product into the water bath when the fill tube is attached to the nozzle. An overflow tube may be provided and may be used to monitor the level of water retained in the water bath.

19 Claims, 4 Drawing Sheets

120 VOLTS AC
2 WIRE
SINGLE PHASE

WATER BATH REFILL SYSTEM

CROSS-REFERENCE TO RELATED APPLICATION

This patent application claims the benefit of priority under 35 U.S.C. §119(e) to United States Provisional Patent Application No. 60/747,795 filed May 20, 2006. The disclosure set forth in the referenced provisional application is incorporated herein by reference in its entirety, including all information as originally submitted to the United States Patent and Trademark Office.

BACKGROUND

This disclosure relates generally to structure and method to facilitate set up and refilling of a water bath component of a beverage dispenser. The water bath is used in a beverage dispenser to provide cooling for the system and the water bath must be set up to fill the water bath prior to operation and subsequently refilled to maintain a desired water level.

The water bath portion of a beverage dispenser provides a heat transfer system which helps maintain a volume of chilled water to remove heat from water which is used in producing a beverage. In a beverage dispensing machine, water and a concentrate or other substance is brought together to reconstitute a beverage. The water and concentrate are brought together to dispense at a dispensing nozzle. In order to reduce the temperature of the water used to mix with the concentrate, the incoming water is fed through a waterline which is submerged or otherwise in contact with water retain in the water bath. Water in the water bath is chilled or frozen so as to remove heat from the water. Water flowing through the inlet lines submerged in the water bath is chilled as a result of this cooling process so that chilled water can be provided to the dispensing nozzle.

The water bath is usually a volume of water which is maintained in the system. The water bath system may have a decrease in water over time due to, by way of example, evaporation or other minor leakage. As a result, the water bath must be periodically inspected and filled to a desired fill level.

While an automatic refill system may be provided, such an automatic refill system requires a connection to the inlet line, valves for controlling the automatic refill as well as sensors and control mechanisms for the automatic refill. The frequency or as the case may be, infrequency, of refilling the water bath may not justify the additional cost required to provide an automatic refill system. Additionally, an automatic refill system may have a negative impact on reliability of the beverage dispenser. In this regard, the extra connections, valves and sensors may introduce problems associated with the system which could be avoided if they were removed from the system. For example, if the inlet valve to the water refill system failed, water may continuously flow into the water bath causing an overflow of the water bath. Additionally, as with any system, additional connections and joints are subject to damage or leakage as a result possibly reducing the viability of the system. While an automatic system is useful during initial setup, they have little utility over the life of the product as the refill cycle occurs infrequently during the life of the product.

Additionally, manually operated water valves connected to the inlet water line have also been provided. While these manual water valves are useful, they are typically connected at the rear of the machine and require an operator to extend a tube to the refill bath. Additionally, due to the configuration of the refill bath in the dispensing device, it may be difficult to observe the level of the water bath. Refilling may be inaccurate or may cause some undesirable overflowing. Additionally, this type of system includes a separate valve which is subject to leaking or failure. Further, since the manually operated valve is connected to a pressurized water line, it may be detrimental to the overall system operation should this valve fail.

BRIEF DESCRIPTION OF THE DRAWINGS

The present disclosure will be described hereafter with reference to the attached drawings which are given as a non-limiting example only, in which.

Figure 1:
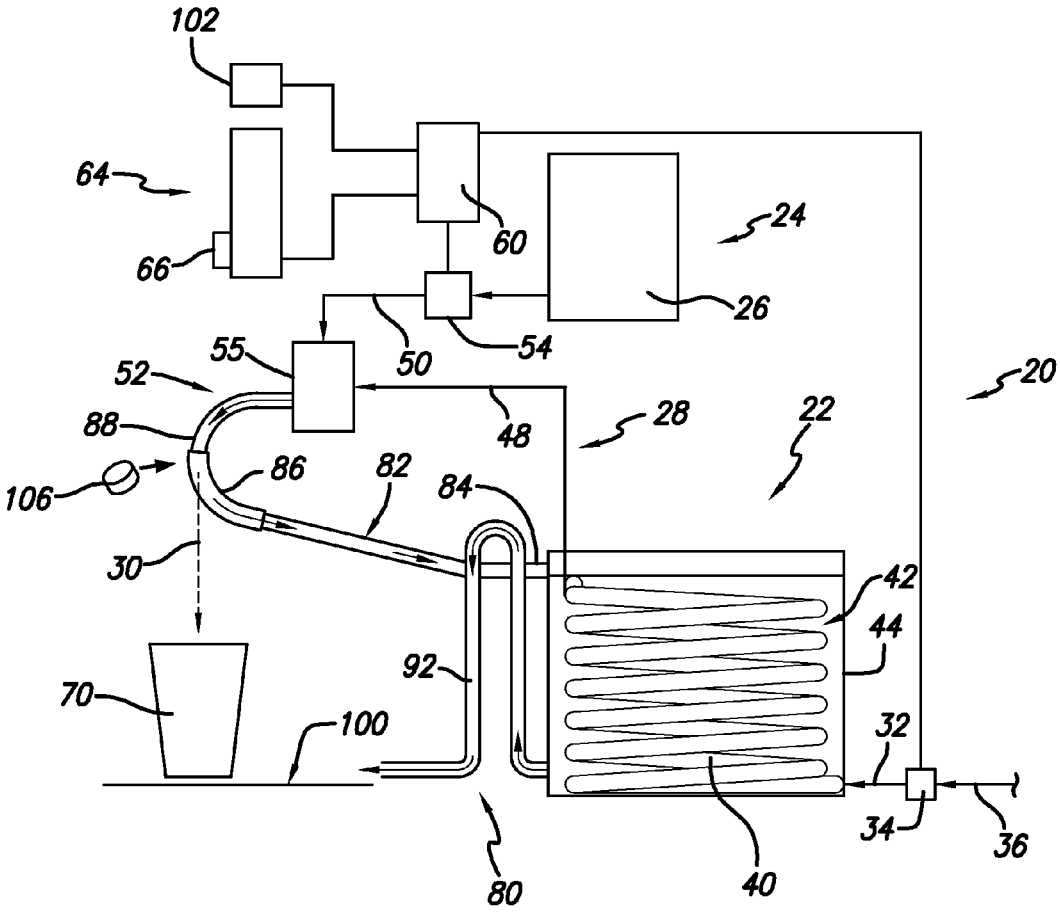
FIG. 1 is a general diagrammatic illustration of a beverage dispenser as disclosed herein including a water bath, concentrate dispenser, controllable dispenser nozzle and a refill system associated with the beverage dispenser for facilitating refilling of the water bath.

The exemplification set out herein illustrates embodiments of the disclosure that is not to be construed as limiting the scope of the disclosure in any manner. Additional features of the present disclosure will become apparent to those skilled in the art upon consideration of the following detailed description of illustrative embodiments exemplifying the best mode of carrying out the disclosure as presently perceived.

DETAILED DESCRIPTION

While the present disclosure may be susceptible to embodiment in different forms, there is shown in the drawings, and herein will be described in detail, embodiments with the understanding that the present description is to be considered an exemplification of the principles of the disclosure and is not intended to be exhaustive or to limit the disclosure to the details of construction and the arrangements of components set forth in the following description or illustrated in the drawings.

With reference to FIG. 1, a general diagrammatic illustration of a beverage dispenser 20 including a water bath system 22, a product dispensing system 24 which controls the mixing of product 26 and water 28 produce a beverage 30. The water bath system 22 includes an inlet line 32 couple to a controllable valve 34 and a pressurized water line or source 36. A coiled inlet line 40 extends through a volume of chilled water 42 retained in a water bath tank 44. Water 28 passing through the coil 40 exits the coil at a nozzle line 48. The nozzle line 48 and a concentrate line 50 are coupled at a controllable nozzle 52. Concentrate is contained in a concentrate container 26 and controllably dispense through a dispensing regulator 54. The dispensing regulator 54 may be by way of example but not limitation, in a form of a controllable valve, a pump or a combination which controls the movement or flow of concentrate through the concentrate line 50.

A controller 60 is coupled to the concentrate regulator 54 and the controllable inlet valve 34. Operation of the beverage dispenser generally is controlled at a controller 64. A dispense control 66 provided on the controller or control panel 64. While a control system as shown and described in FIG. 1 is provided, alternative control systems have been developed and may be substituted for the control system shown herein. Primarily, the control system controls the flow of concentrate and water to a mixing chamber 55 and through the nozzle 52 for dispensing of a beverage 30 into a cup or other container 70. Control can occur in the concentrate line, the nozzle water line 48, inlet line 32 as well as at the nozzle 52. In this regard, controllable nozzles have been developed which are coupled to a controller 60 which control the dispensing of beverage 30. As such, the present disclosure is not limited to the type of control system but will instead focus on the use of a refill system 80 as disclosed herein.

The refill system 80 includes a fill tube 82 coupled to the water bath 44 generally at the top level of the water level or slightly above the desired water level. The refill line 82 is connected to an upper portion of the water bath housing 44 at the entry end 84. For ease of use the tube 82 is generally positioned on the front of the water bath to facilitate access to the nozzle 52 on the front of the dispenser. An adaptor or connecting end 86 is attached to a terminal end 88 of the nozzle 52. The adapter end 86 may include an adapter which is sized and dimensioned for connecting to the terminal end 88 of the nozzle 52 or may be of a size and dimension which does not require an adapter. Regardless of the specific dimensional characteristics, the refill tube 82 provides a connection and path between the nozzle 52 and the water bath 44 for transferring water from the nozzle to the water bath.

An overflow tube 92 is connected to the water bath and routed towards the front of the water bath to provide the ability to monitor the water level as the bath is filled. Water which exceeds the desired level can flow into a drip tray. In this regard, the overflow tube provides a water level site gauge to determine if a desired level is achieved. In the embodiment as shown in FIG. 1, the overflow tube is connected towards the bottom of the tank 44 and extends upwardly along the front of the tank. An elbow toward the top extends generally above the water level so that if the water level is achieved or exceeded, water will flow through the tube into a drain area 100.

Figure 2:
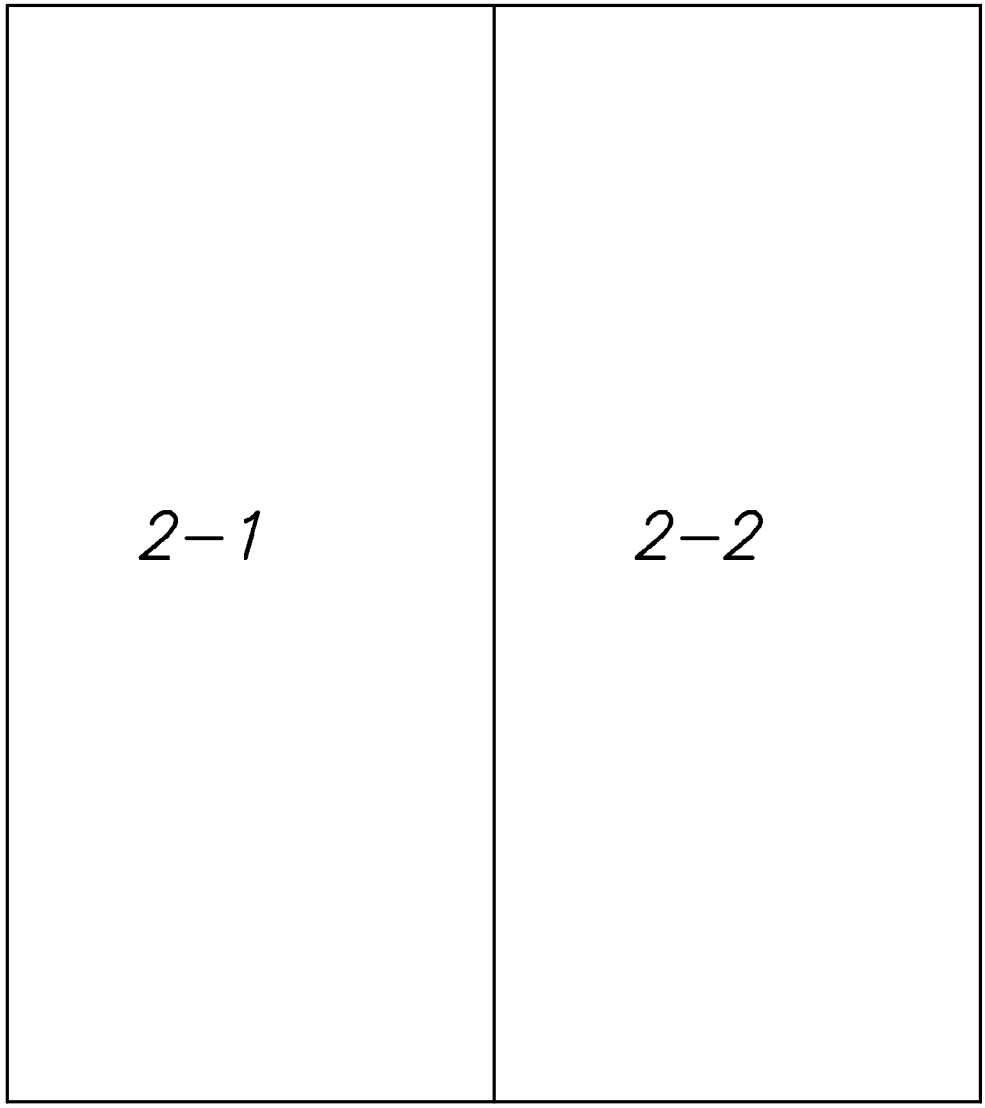
FIG. 2 is a schematic of the system of FIG. 1, a legend is provided for FIG. 2 as it spans 2 sheets of drawings and is identified by 2-1, 2-2.
Figures 1, 2:
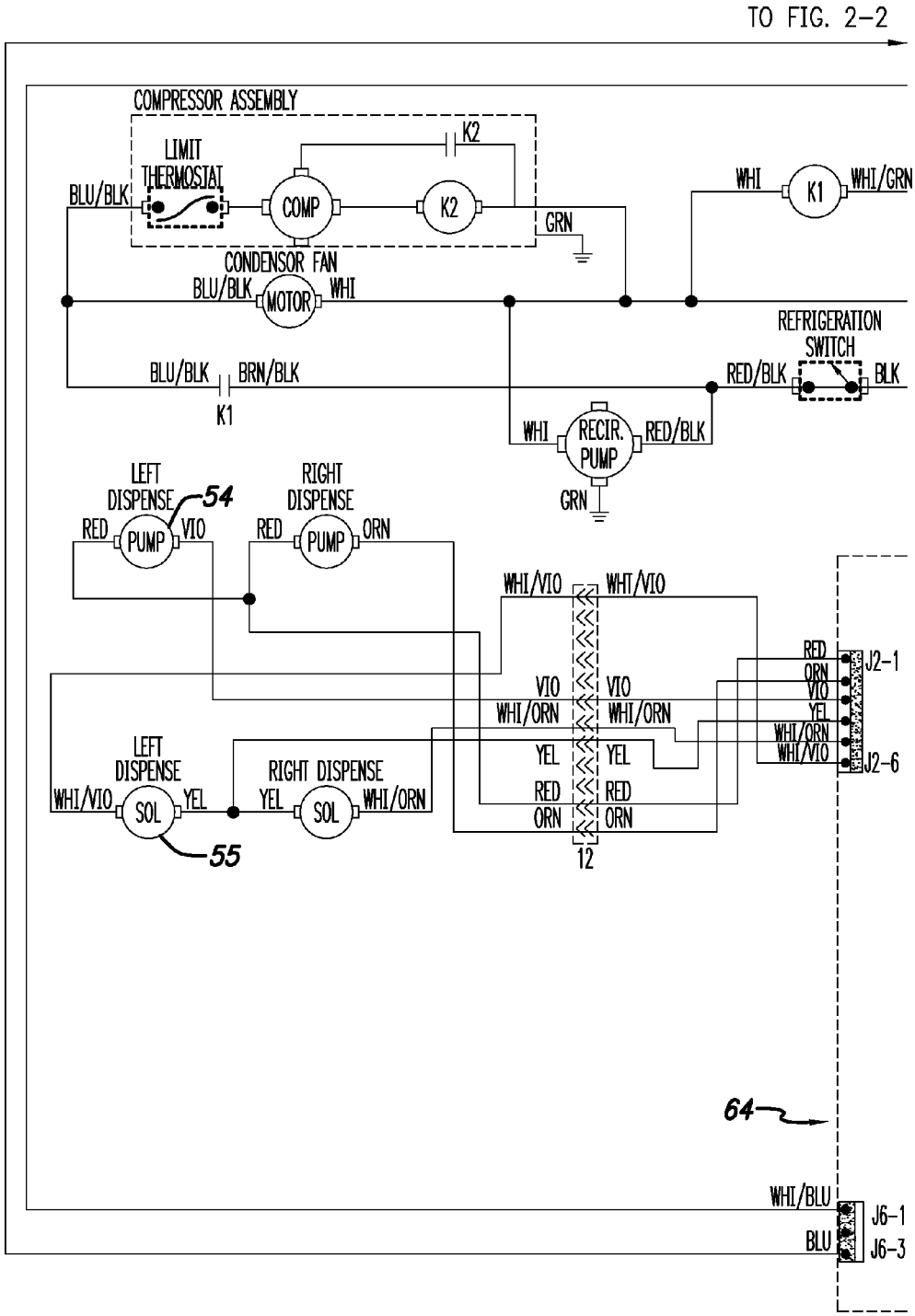
Figure 2:
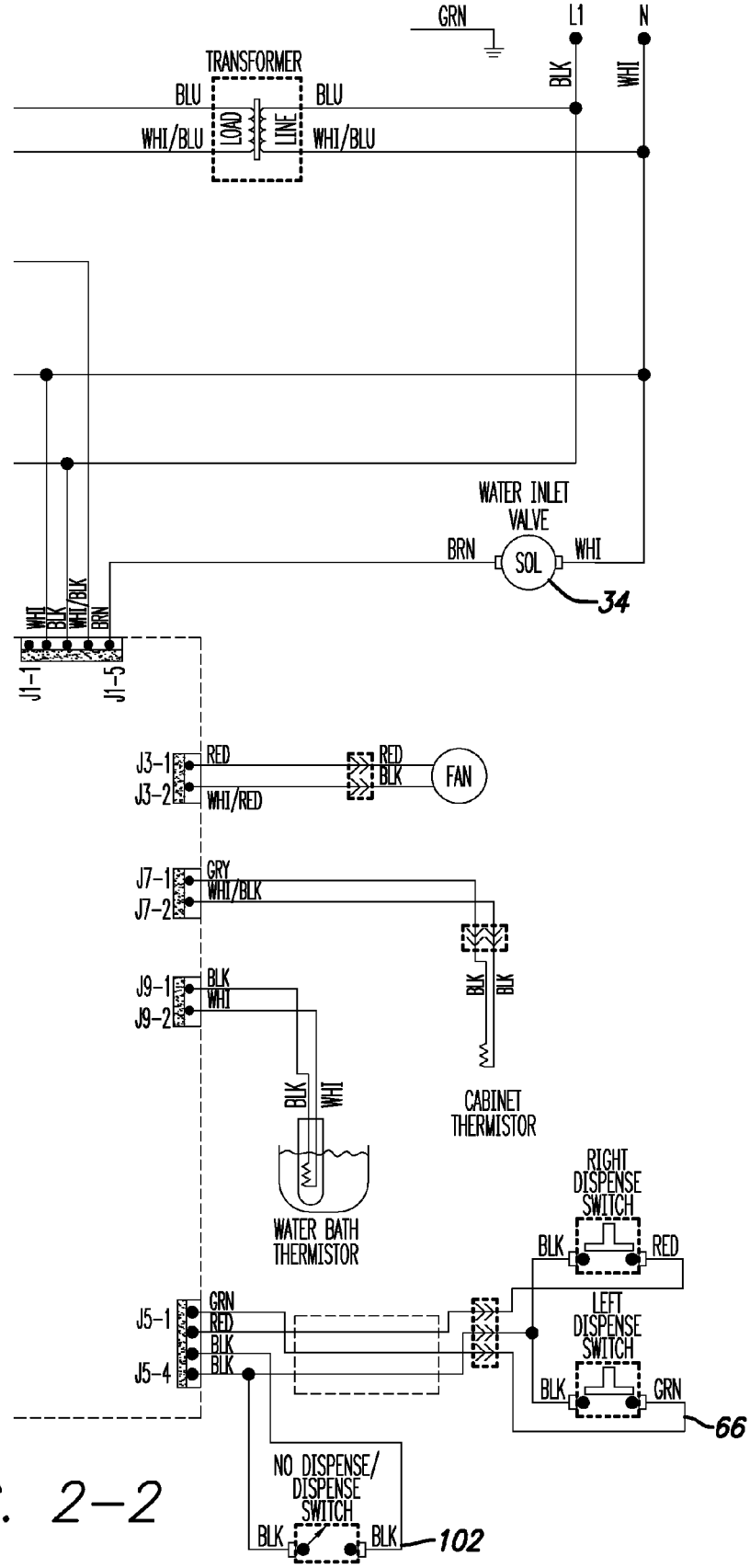

In use, an operator can use the refill system 80 to fill the water bath tank 44 when setting up a dispenser or to refill the tank periodically. The operator connects the refill line 82 to the nozzle 52 by connecting the connection end 86 of the tube to the terminal end 88 of the nozzle. The operator then uses a dispense control switch to turn off the dispensing mode of the machine. The dispense control switch 102 (see FIG. 2-2) allows controllable dispensing of water but stops all dispensing of concentrate. In this way, the operator can control the flow of water into the water bath 44 but does not dispense any concentrate through the nozzle 52. The dispense control switch disables the concentrate dispenser 26 to prevent dispensing of concentrate to the tank. In other words, when the dispense control switch 102 is switched to "no dispense", the dispenser will dispense water but not concentrate and as a result, no beverage will be produced.

Once the dispense switch 102 has been moved to the "no dispense" position, the operator can use a dispensing control button 66 coupled to the controller 60 to controllably dispense water into the water bath 44. When the operator sees that a desired level has been achieved as shown in the tube 92 or water begins overflowing into the drain 100 the operator can stop the dispensing of water into the water bath.

When the filling has been completed, the operator removes the line 82 from the nozzle 52 and replaces a cap or stopper 106 on the end 86 of the line. The line can then be positioned in the dispenser housing for subsequent use. When a service person or other person periodically checks on the water bath, they can go through the cycle again to top off or refill the water bath to its desired level. This eliminates the need of having to run lines from the rear of the machine and eliminates the need for additional valves or controls which might otherwise have a potential adverse effect on the overall system and add cost to the system.

While this disclosure has been described as having an exemplary embodiment, this application is intended to cover any variations, uses, or adaptations using its general principles. It is envisioned that those skilled in the art may devise various modifications and equivalents without departing from the spirit and scope of the disclosure as recited in the following claims. Further, this application is intended to cover such departures from the present disclosure as come within the known or customary practice within the art to which it pertains.

The invention claimed is:

1. A beverage dispenser including a water bath for cooling water used in a beverage dispensing cycle, the beverage dispenser comprising:

at least one controllable inlet line for delivering water to the dispenser, at least one product dispenser, at least one mixing chamber having a nozzle for dispensing at least one of water or a combination of water and product, a controller coupled to the product dispenser and the inlet line, and a refill system communicating with the water bath for providing water to the water bath, the refill system including a fill tube having a first end attached to and communicating with the water bath and a second end for selective manual attachment directly to the nozzle for controllably dispensing water flowing from the inlet line through the nozzle to refill water in the water bath.

2. The beverage dispenser of claim 1, further comprising an overflow line coupled to the water bath for allowing excess water from the bath to flow out of the bath.

3. The beverage dispenser of claim 2, further comprising the overflow line being at least partially transparent for viewing the water level of liquid in the water bath.

4. The beverage dispenser of claim 1, further comprising the refill system including the fill tube coupled to and communicating with the water bath generally at an upper area of the water bath.

5. The beverage dispenser of claim 1, further comprising the fill tube connected at one end to the water refill bath and having a distal end with an adapter for connecting to the nozzle.

6. The beverage dispenser of claim 1, the controller providing a function to prevent dispensing of product and to facilitate dispensing of water for passing water through the refill system to the water bath.

7. The beverage dispenser of claim 1, comprising the tube being attached to and communicating with the water bath generally on a front portion of the water bath for connection to the nozzle.

8. A method for refilling a water bath used with a beverage dispenser, the method comprising the steps of:

providing a nozzle on the beverage dispenser for at least dispensing water, providing a fill tube having an entry end coupled to and communicating with the water bath, providing an adapter end on the fill tube, coupling the adapter end of the fill tube to the nozzle of the beverage dispenser, operating the dispenser to dispense water from the dispenser through the nozzle and into the fill tube, and passing water through the fill tube to the water bath until a selected level is achieved.

9. The method of claim 8, further comprising the steps of:

providing a controller on the beverage dispenser, operating the controller to prevent dispensing of product from the beverage dispenser, and operating the controller to dispense only water through the nozzle for passage to the fill tube and into the water bath.

10. The method of claim 8, further comprising the steps of:

connecting the fill tube to a nozzle, operating the beverage dispenser to pass water from the nozzle through the fill tube, filling the water bath to a desired level, and ceasing dispensing of water to the water bath upon achieving a desired level.

11. The method of claim 10, further comprising the steps of:

disengaging the fill tube from the nozzle upon achieving a desired level, covering an end of the fill tube which was coupled to the nozzle, and storing the fill tube, connected to the water bath, in the beverage dispenser.

12. The method of claim 10, further comprising the steps of:

providing an overflow tube coupled to the water bath, monitoring the overflow tube to estimate the level of water in the water bath.

13. In a beverage dispenser including a water bath for cooling water, the dispenser including a controllable inlet line for delivering water to the dispenser, a nozzle on the dispenser for dispensing at least one of water and beverage, a controller coupled to the inlet line, a water bath refill system comprising:

a fill tube having an entry end coupled to the water bath, an adapter end of the fill tube being sized and dimensioned for selective manual attachment directly to the nozzle for controllably dispensing water directly from the nozzle through the fill tube to dispense water to the water bath.

14. In the beverage dispenser of claim 13, the water bath refill system further comprising an overflow line coupled to the water bath for allowing excess water from the bath to flow out of the bath.

15. In the beverage dispenser of claim 14, the water bath refill system further comprising the overflow line being at least partially transparent for viewing the water level of liquid in the water bath.

16. In the beverage dispenser of claim 13, the water bath refill system further comprising the refill system including the fill tube coupled to and communicating with the water bath generally at an upper area of the water bath.

17. In the beverage dispenser of claim 13, the water bath refill system further comprising the fill tube connected at one end to the water refill bath and having a distal end with an adapter for connecting to the nozzle.

18. In the beverage dispenser of claim 13, the water bath refill system further comprising the controller providing a function to prevent dispensing of beverage and to facilitate dispensing of water for passing water through the refill system to the water bath.

19. In the beverage dispenser of claim 13, the water bath refill system further comprising the tube being attached to and communicating with the water bath generally on a front portion of the water bath for connection to the nozzle.

* * * * *